US009803480B2

(12) United States Patent
Hoefler et al.

(10) Patent No.: US 9,803,480 B2
(45) Date of Patent: Oct. 31, 2017

(54) LIQUID RING TURBINE AND METHOD OF USE

(71) Applicant: General Electric Company, Schenectady, NY (US)

(72) Inventors: Florian Hoefler, Garching (DE); Massimiliano Cirri, Munich (DE); Sean Craig Jenkins, Haimhuasen (DE)

(73) Assignee: General Electric Company, Niskayuna, NY (US)

( * ) Notice: Subject to any disclaimer, the term of this patent is extended or adjusted under 35 U.S.C. 154(b) by 320 days.

(21) Appl. No.: 14/576,502

(22) Filed: Dec. 19, 2014

(65) Prior Publication Data

US 2016/0177721 A1 Jun. 23, 2016

(51) Int. Cl.

| | |
|---|---|
| ***F04C 19/00*** | (2006.01) |
| ***F01C 17/02*** | (2006.01) |
| ***F01C 21/08*** | (2006.01) |
| ***F01C 7/00*** | (2006.01) |
| ***F01C 13/00*** | (2006.01) |

(52) U.S. Cl.

CPC ..... *F01C 7/00* (2013.01); *F01C 13/00* (2013.01); *F01C 21/0809* (2013.01); *F04C 2240/20* (2013.01)

(58) Field of Classification Search

CPC ..... F01C 21/0809; F01C 7/00; F04C 2240/20

USPC ..... 418/96; 417/68

See application file for complete search history.

(56) References Cited

U.S. PATENT DOCUMENTS

| | | | |
|---|---|---|---|
| 2,201,947 A | 5/1940 | Valentine | |
| 3,298,444 A | 1/1967 | Haas | |
| 3,522,997 A | 8/1970 | Rylewski | |
| 3,964,841 A | 6/1976 | Strycek | |

(Continued)

FOREIGN PATENT DOCUMENTS

| | | | |
|---|---|---|---|
| CN | 201059284 Y | 5/2008 | |
| CN | 202338512 U | 7/2012 | |
| DE | 952445 C | * 11/1956 | ..... F01C 7/00 |

OTHER PUBLICATIONS

Reza Afshar Ghotli et al., "Study of various curved-blade impeller geometries on power consumption in stirred vessel using response surface methodology", Journal of the Taiwan Institute of Chemical Engineers, Science Direct, Mar. 2013, vol. 44, Issue 2, pp. 192-201.

*Primary Examiner* — Mark Laurenzi
*Assistant Examiner* — Anthony Ayala Delgado
(74) *Attorney, Agent, or Firm* — John P. Darling

(57) ABSTRACT

A liquid ring turbine has a casing defining an interior chamber with a symmetry axis. A shaft, having an axis substantially parallel to the symmetry axis, is eccentrically positioned to the symmetry axis. An impeller is coupled to the shaft and is configured to rotate in a first direction. The impeller includes a plurality of vanes extending away from the shaft in a second direction at least partially opposite the first direction. The impeller rotates within a liquid ring enclosed in the casing such that a plurality of expansion chambers are defined. Each expansion chamber is defined between adjacent vanes and the liquid ring. A gas inlet port is in fluid communication with a first expansion chamber defining a first volume. A gas outlet port is in fluid communication with a second expansion chamber. The second expansion chamber defines a second volume that is greater than the first volume.

20 Claims, 4 Drawing Sheets

(56) References Cited

U.S. PATENT DOCUMENTS

| | | | | |
|---|---|---|---|---|
| 4,720,243 | A | 1/1988 | Katayama et al. | |
| 4,775,270 | A | 10/1988 | Katayama et al. | |
| 6,082,000 | A | 7/2000 | Fornasa | |
| 7,281,379 | B2 | 10/2007 | Brasz | |
| 7,409,997 | B2 * | 8/2008 | Gay | E21B 43/128 166/105 |
| 8,556,584 | B2 | 10/2013 | Mallaiah et al. | |
| 2014/0147244 | A1 * | 5/2014 | Cantemir | F01C 7/00 415/1 |

* cited by examiner

LIQUID RING TURBINE AND METHOD OF USE

BACKGROUND

The subject matter described herein relates generally to liquid ring turbines, and more specifically, to apparatus, systems, and methods for increasing the efficiency of the liquid ring turbine.

Some known liquid ring expanders include an impeller having vanes mounted thereon, where the impeller is mounted eccentrically in a casing. A liquid is present in the casing and is cast against an outer wall of the casing as a result of the centrifugal forces generated by rotation of the impeller. The volume of the liquid is less than the volume of the casing, thereby enabling the liquid to form a liquid ring within the casing. The liquid ring interacts with the vanes of the impeller to form expansion chambers bounded by two adjacent vanes and the liquid ring. Due to the eccentric location of the impeller in the casing, the volume of the expansion chambers progressively increases in the direction of rotation of the impeller, enabling an injected gas to expand in the expansions chambers and rotate the impeller.

In operation, in some know liquid ring expanders a high pressure gas is injected into a gas inlet corresponding to a small volume of the expansion chambers. The high pressure gas impacts the impeller vanes, causing the impeller to rotate. Due to the eccentric rotation of the impeller, the expansion chamber increases in volume and the high pressure gas expands. As the gas expands, its pressure and temperature decrease. The expanded gas is then channeled out of the liquid ring expander through a gas outlet corresponding to a large volume of the expansion chambers.

At least some known liquid ring expanders include straight radially extending vanes on the impeller. In addition, some known liquid ring expanders include rotating casings due to the friction between the fluid and a fixed casing being prohibitive to obtaining reasonable efficiency. Furthermore, in some known liquid ring turbines, the interactions between the liquid ring, the impeller vanes, and the compressed gas, results in decreased efficiency of the liquid ring turbine.

BRIEF DESCRIPTION

In one aspect, a liquid ring turbine is provided. The liquid ring turbine includes a casing defining an interior chamber having an axis of symmetry. A shaft, having a longitudinal axis substantially parallel to the axis of symmetry, is eccentrically positioned to the axis of symmetry. An impeller is rotatably coupled to the shaft and is configured to rotate in a first direction. The impeller includes a plurality of vanes extending away from the shaft in a second direction at least partially opposite the first direction. The impeller is configured to rotate in the first direction within a liquid ring enclosed within the casing so as to define a plurality of expansion chambers. Each expansion chamber of the plurality of expansion chambers is defined between a pair of adjacent vanes and the liquid ring. A gas inlet port is in fluid communication with a first expansion chamber of the plurality of expansion chambers. The first expansion chamber of the plurality of expansion chambers defines a first volume. A gas outlet port is in fluid communication with a second expansion chamber of the plurality of expansion chambers. The second expansion chamber of the plurality of expansion chambers defines a second volume that is greater than the first volume.

In another aspect, a liquid ring power system is provided. The power system includes an enthalpy source configured to generate a compressed gas flow. The system also includes a liquid ring turbine configured to receive the compressed gas flow. The liquid ring turbine includes a casing defining an interior chamber having an axis of symmetry. A shaft, having a longitudinal axis substantially parallel to the axis of symmetry, is eccentrically positioned to the axis of symmetry. An impeller is rotatably coupled to the shaft and is configured to rotate in a first direction. The impeller includes a plurality of vanes extending away from the shaft in a second direction at least partially opposite the first direction. The impeller is configured to rotate in the first direction within a liquid ring enclosed within the casing so as to define a plurality of expansion chambers. Each expansion chamber of the plurality of expansion chambers is defined between a pair of adjacent vanes and the liquid ring. The liquid ring turbine also includes a gas inlet port in fluid communication with the gas source and a first expansion chamber of the plurality of expansion chambers. The first expansion chamber of the plurality of expansion chambers defines a first volume. A gas outlet port is in fluid communication with a second expansion chamber of the plurality of expansion chambers. The second expansion chamber of the plurality of expansion chambers defines a second volume greater than the first volume. Furthermore, the system includes a load rotatably coupled to at least one of the shaft and the impeller of the liquid ring turbine.

In yet another aspect, a method for extracting energy from a compressed gas flow using a liquid ring turbine is provided. The method includes providing a casing including an impeller configured to rotate in a first direction and having a plurality of vanes extending in a second direction at least partially opposite the first direction. The impeller is positioned eccentrically in the casing and is configured to rotate within a liquid ring so as to define a plurality of expansion chambers. Each expansion chamber of the plurality of expansion chambers is defined between a pair of adjacent vanes of the impeller and the liquid ring. The method includes injecting a compressed gas flow into a first expansion chamber of the plurality of expansion chambers. The first expansion chamber defines a first volume. The compressed gas flow has a first temperature and a first pressure. Moreover, the method includes impacting at least one vane of the plurality of vanes with the compressed gas flow so as to rotate the impeller. In addition, the method includes expanding the first volume of the first expansion chamber to a second volume greater than the first volume as the impeller rotates, thereby generating an expanded gas flow.

DRAWINGS

These and other features, aspects, and advantages of the present disclosure will become better understood when the following detailed description is read with reference to the accompanying drawings in which like characters represent like parts throughout the drawings, wherein.

Figure 2:
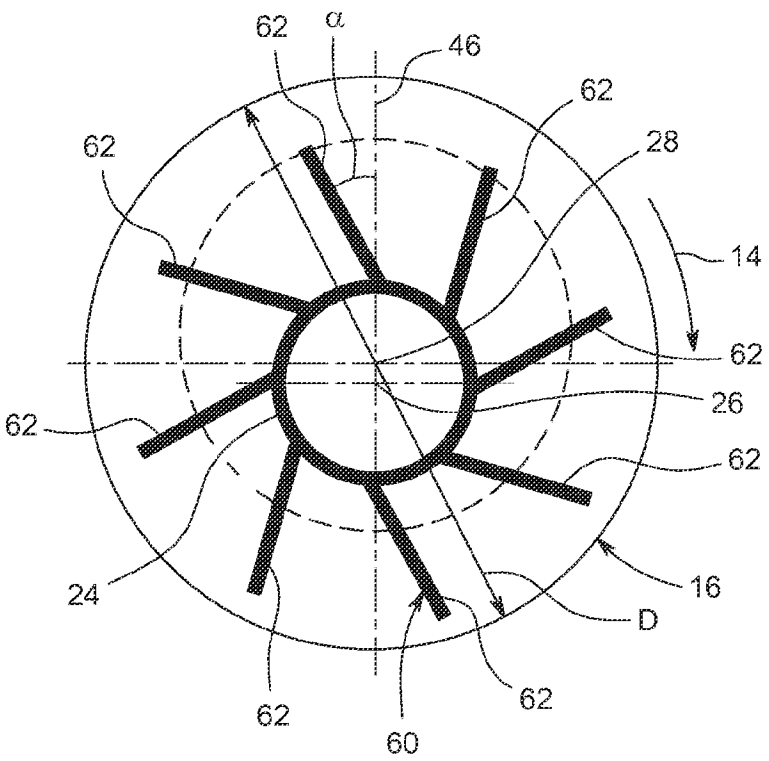
FIG. 2 is a schematic cross-section of the liquid ring turbine shown in FIG. 1 including an impeller having a plurality of backward inclined vanes.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The terms "radial" and "radially" refer to directions and orientations extending substantially perpendicular to the longitudinal axis of the liquid ring turbine. In addition, as used herein, the terms "circumferential" and "circumferentially" refer to directions and orientations extending arcuately about the longitudinal axis of the liquid ring turbine.

The term "parameter" refers to characteristics that can be used to define the operational conditions of the liquid ring turbine, such as temperatures, pressures, structural dimensions, and/or fluid flows at defined locations within the liquid ring turbine. Some parameters are measured, i.e., are sensed and are directly known, while other parameters are calculated and are thus estimated and indirectly known. The measured, estimated, or user input parameters represent a given operational condition of the liquid ring turbine.

The apparatus, system, and methods described herein facilitate increasing the efficiency of a liquid ring turbine by configuring impeller vanes to have a backward swept, curved or straight, configuration with respect to a direction of rotation of the impeller. A high pressure and high temperature gas is injected into the liquid ring turbine to impact the impeller vanes, and thus impart work on the impeller to cause it to rotate. The impeller vanes are turned in a direction away from rotation of the impeller such that the turned impeller vanes are substantially parallel to a force generated by the gas at an interface between the gas volume and a liquid ring contained within the liquid ring turbine. As the impeller rotates, an expansion chamber containing the gas volume expands, thereby expanding the high pressure and high temperature gas. As the gas expands, its temperature and pressure decrease, and as a result, an angle of the interface relative to the impeller vanes changes. A backward curved shape of the impeller vanes is determined to facilitate maintaining the impeller vane substantially parallel to the force generated by the gas. As such, the embodiments described herein provide for increasing the power output, or efficiency, of the liquid ring turbine by inclining or curving the blades correctly. This facilitates reducing energy losses in the system and facilitates increasing operating profits of the system.

Figure 1:
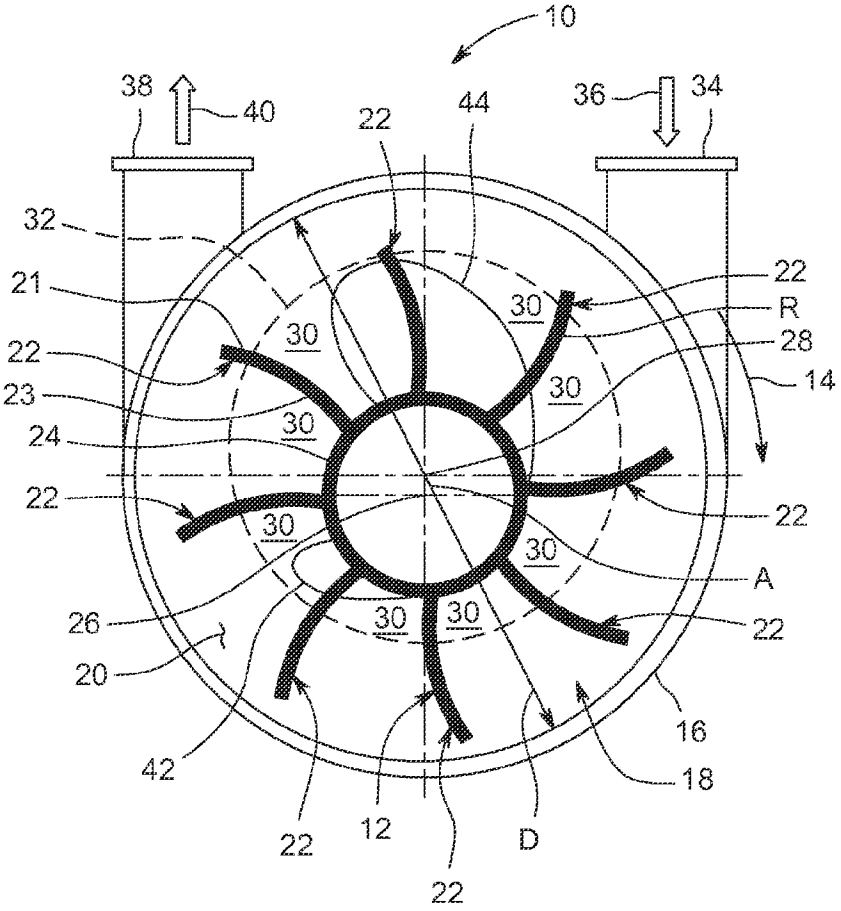
FIG. 1 is a schematic cross-section of a liquid ring expander, or turbine, including an impeller.

FIG. 1 is a schematic cross-section of a liquid ring expander, or turbine 10 including an impeller 12. In the exemplary embodiment, impeller 12 rotates clockwise, as generally indicated by arrow 14. Impeller 12 is enclosed within a casing 16 that defines a substantially round interior chamber 18 containing a liquid ring 20 formed from a liquid, for example, without limitation, water or oil. Impeller 12 includes a plurality of equispaced backward curved vanes 22, i.e. symmetrically arranged, about a shaft 24. In the exemplary embodiment, impeller 12 includes eight impeller vanes 22. Alternatively, impeller 12 includes any number of impeller vanes 22 that enable liquid ring turbine 10 to function as described herein. In the exemplary embodiment, impeller 12 is rotatably coupled to shaft 24, which includes a longitudinal axis 26 and is eccentrically positioned with respect to an axis of symmetry 28 of interior chamber 18. For example, in the exemplary embodiment, longitudinal axis 26 is offset a predefined distance A from axis 28 of chamber 18. In one embodiment, shaft 24 is stationary and impeller 12 is rotatably coupled to shaft 24 by, for example, without limitation, bearings. Alternatively, shaft 24 is a rotatable shaft and impeller 12 is coupled to shaft 24 for rotation therewith.

In the exemplary embodiment, casing 16 is configured to rotate about axis of symmetry 28, which facilitates increased system efficiency. In such an embodiment, casing 16 and impeller 12 are rotated at substantially the same speed to facilitate increasing efficiency of liquid ring turbine 10 and reducing frictional forces between liquid ring 20 and impeller 12. Means for rotatably mounting casing 16 to enable rotation thereof include, for example, without limitation, rollers, sleeves, and bearings. Alternatively, casing 16 is fixed and cannot rotate about axis of symmetry 28.

In the exemplary embodiment, liquid ring 20 is formed about interior chamber 18 as impeller 12 rotates therein. For example, without limitation, the liquid is directed into chamber 18 and, by centrifugal acceleration, forms rotating cylindrical liquid ring 20 against the inside of casing 16. An inner radial boundary 32 of liquid ring 20 is shown as a broken line in FIG. 1. As shown in FIG. 1, liquid ring 20 remains in contact with each of impeller vanes 22, thus creating a series of sealed expansion chambers 30 defined between adjacent impeller vanes 22, liquid ring 20, and shaft 24. The eccentricity between longitudinal axis 26 and axis of symmetry 28 of interior chamber 18 functions to vary the volume of expansion chambers 30 as impeller 12 rotates within casing 16.

In the exemplary embodiment, an inlet duct 34, configured to receive a compressed gas flow, generally indicated by arrow 36, is coupled to casing 16. In addition, an outlet duct 38, configured to discharge an expanded gas flow, generally indicated by arrow 40, is also coupled to casing 16. More specifically, inlet duct 34 and outlet duct 38 are coupled in fluid communication with interior chamber 18. In the exemplary embodiment, compressed gas flow 36 is at a higher pressure and temperature than expanded gas flow 40. Furthermore, compressed gas flow 36 is at an increased pressure and temperature with respect to ambient conditions. Compressed gas flow 36 flows along inlet duct 34 and passes through a gas inlet port 42 into one or more of expansion chambers 30. Generally, the pressure of compressed gas flow 36 within expansion chambers 30 in fluid communication with inlet port 42 is substantially the same as the pressure of compressed gas flow 36 within inlet duct 34. Furthermore, expanded gas flow 40 exits one or more expansion chambers 30 and passes through a gas outlet port 44 and into outlet duct 38. Generally, the pressure of expanded gas flow 40 within expansion chambers 30 in fluid communication with outlet port 44 is substantially the same as the pressure of expanded gas flow 40 that flows within outlet duct 38.

In operation, compressed gas flow 36 is directed into interior chamber 18 through gas inlet port 42 where it impacts impeller vanes 22, thereby generating rotation of impeller 12. Gas inlet port 42 is located proximate to where impeller vanes 22 are nearest to inner radial boundary 32 of liquid ring 20, such that the varying size expansion chamber 30 is near its smallest size, thus having a reduced volume. As impeller 12 rotates, a fixed volume of compressed gas flow 36 trapped in expansion chamber 30 is expanded as the volume of expansion chamber 30 expands due to the eccentricity between longitudinal axis 26 and axis of symmetry 28 of interior chamber 18. Expanded gas flow 40 exits interior chamber 18 through gas outlet port 44 at a lower pressure and temperature than compressed gas 36. Gas outlet port 44 is located proximate to where impeller vanes 22 are furthest from inner radial boundary 32 of liquid ring 20, such that the varying size expansion chamber 30 is near its largest size, thus having an increased volume as compared to its volume when proximate gas inlet port 42.

As shown in FIG. 1, impeller vanes 22 are backward curved vanes. Each of impeller vanes 22 includes a convex side 21 and a concave side 23, with convex side 21 leading concave side 23 with respect to the direction of rotation 14. That is, impeller vanes 22 extend radially outward from shaft 24 and have a curvature at least partially in a direction opposite the direction of rotation 14. In one embodiment, for example, without limitation, impeller vanes 22 extend substantially radially outward proximate shaft 24 and curve backward in a direction opposite the direction of rotation 14.

FIG. 2 is a schematic cross-section of liquid ring turbine 10 including an impeller 60 having a plurality of backward inclined vanes 62. Impeller vanes 62 are characterized by the fact that while they are flat and extend in a substantially radial direction from shaft 24, the plane of the vane does not pass through longitudinal axis 26, but is inclined backwardly, or in a direction at least partially opposite to the direction of rotation 14 at an angle $\alpha$ with respect to a radial line 46 extending from shaft 24.

Figure 3:
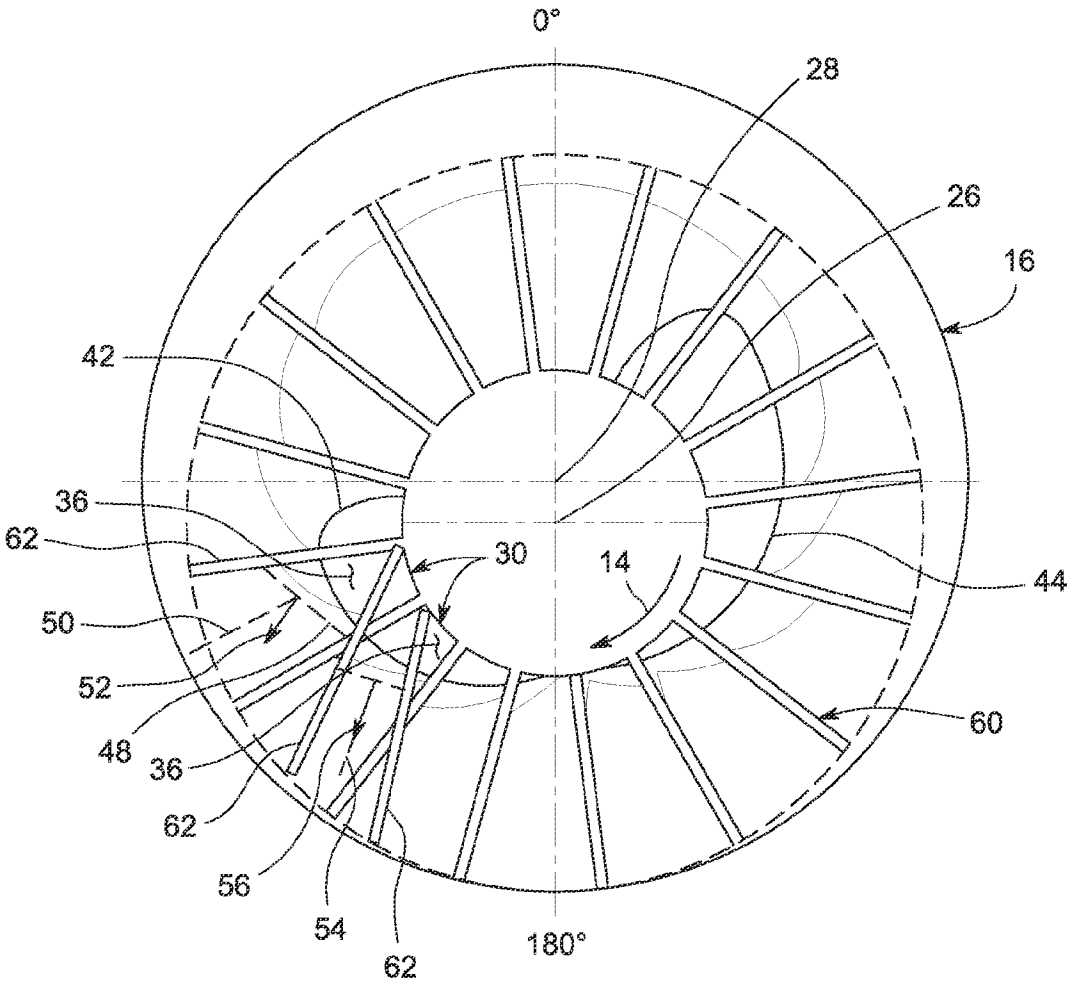
FIG. 3 is a schematic cross-section of the liquid ring turbine shown in FIG. 1, illustrating the balance of forces acting at an interface between a liquid ring and a compressed gas flow contained within expansion chambers.

FIG. 3 is a schematic cross-section of liquid ring turbine 10 illustrating the balance of forces acting at an interface 48 between liquid ring 20 and compressed gas flow 36 contained within expansion chambers 30. As shown in FIG. 3, impeller 12 is illustrated with different configurations of impeller vanes 62, including both radially extending vanes and backward inclined vanes. Liquid ring turbine 10 includes an expansion phase of compressed gas flow 36 that generally extends between inlet 42 and approximately the 0° mark of liquid ring turbine 10. That is, compressed gas flow 36 is expanded in expansion chambers 30 as impeller 12 rotates between inlet 42 and the 0° mark of liquid ring turbine 10. Alternatively, the expansion phase can be defined between inlet 42 and any radial location of liquid ring turbine 10. Furthermore, liquid ring turbine 10 includes an exhaust phase that generally extends between approximately the 0° position of liquid ring turbine 10 and outlet 44.

In the exemplary embodiment, line 50 illustrates the impeller vane direction of the illustrated straight radial impeller vanes 62. Compressed gas flow 36 flows through inlet 42 and expands in expansion chamber 30 as impeller 12 rotates from inlet 42 to the approximately 0° mark of liquid ring turbine 10. Compressed gas flow 36 generates a generally radially outward force against liquid ring 20 at interface 48. A force vector 52 illustrates the force vector of compressed gas flow 36 during the expansion phase of compressed gas flow 36. Force vector 52 extends substantially perpendicular to interface 48. As shown in FIG. 3, force vector 52 is not aligned with the radial vane direction, indicated by line 50. Thus, during the expansion phase, compressed gas flow 36 generates a force against the straight radial configuration of impeller vanes 62 that is opposite to the direction of rotation 14 of impeller 12. This force causes a negative effect on the momentum transfer of compressed gas flow 36 to impeller vanes 62.

Moreover, as shown in FIG. 3, line 54 illustrates the impeller vane direction of backward inclined impeller vanes 62. A force vector 56 illustrates the force vector of compressed gas flow 36 during the expansion phase of compressed gas flow 36. Force vector 56 extends substantially perpendicular to interface 48. As shown in FIG. 3, force vector 56 is aligned with the backward inclined vane direction, as indicated by line 54. That is, force vector 56 extends outward at an angle substantially equal to angle $\alpha$ (shown in FIG. 2) of vanes 62. Thus, compressed gas flow 36 does not generate a force against the backward inclined configuration of impeller vanes 62 during the expansion phase of compressed gas flow 36, and therefore does not have a negative effect on the momentum transfer of compressed gas flow 36 to impeller 12, thereby facilitating increasing the efficiency of liquid ring turbine 10.

With reference to FIGS. 1-3, a curvature R of backward curved vanes 22 and angle $\alpha$ of backward inclined vanes 62 is predetermined based on a number of parameters including for example, without limitation, the eccentricity between longitudinal axis 26 and axis of symmetry 28 of interior chamber 18, liquid ring 20 fill level, the rotational speed of impeller 12, and a diameter D of interior chamber 18. As shown in FIG. 3, an angle of interface 48 with respect to the radial configuration of impeller vanes 62 varies during the expansion phase of compressed gas flow 36. Thus, referring to FIG. 2, angle $\alpha$ is determined, based on at least one of the parameters described above, to provide substantial alignment with force vector 56 during the expansion phase of compressed gas flow 36. However, as impeller 60 rotates, the angle of interface 48 varies, thus facilitating reducing the realized efficiency of liquid ring turbine 10 due to the backward inclination of impeller vanes 62.

Referring to FIG. 1, curvature R of backward curved vanes 22 is determined, based on at least one of the parameters described above, to provide substantial alignment with force vector 56 during the entire expansion phase of compressed gas flow 36. Thus, curvature R is determined such that as the angle of interface 48 varies with the increasing volume of expansion chamber 30 during the expansion phase of compressed gas flow 36, force vector 56 remains substantially aligned with the impeller vane direction, i.e., the direction of the vane at a point tangent to the point interface 48 contacts vane 62, thereby facilitating maintaining the realized efficiency of liquid ring turbine 10 due to the backward curvature of impeller vanes 22.

Figure 4:
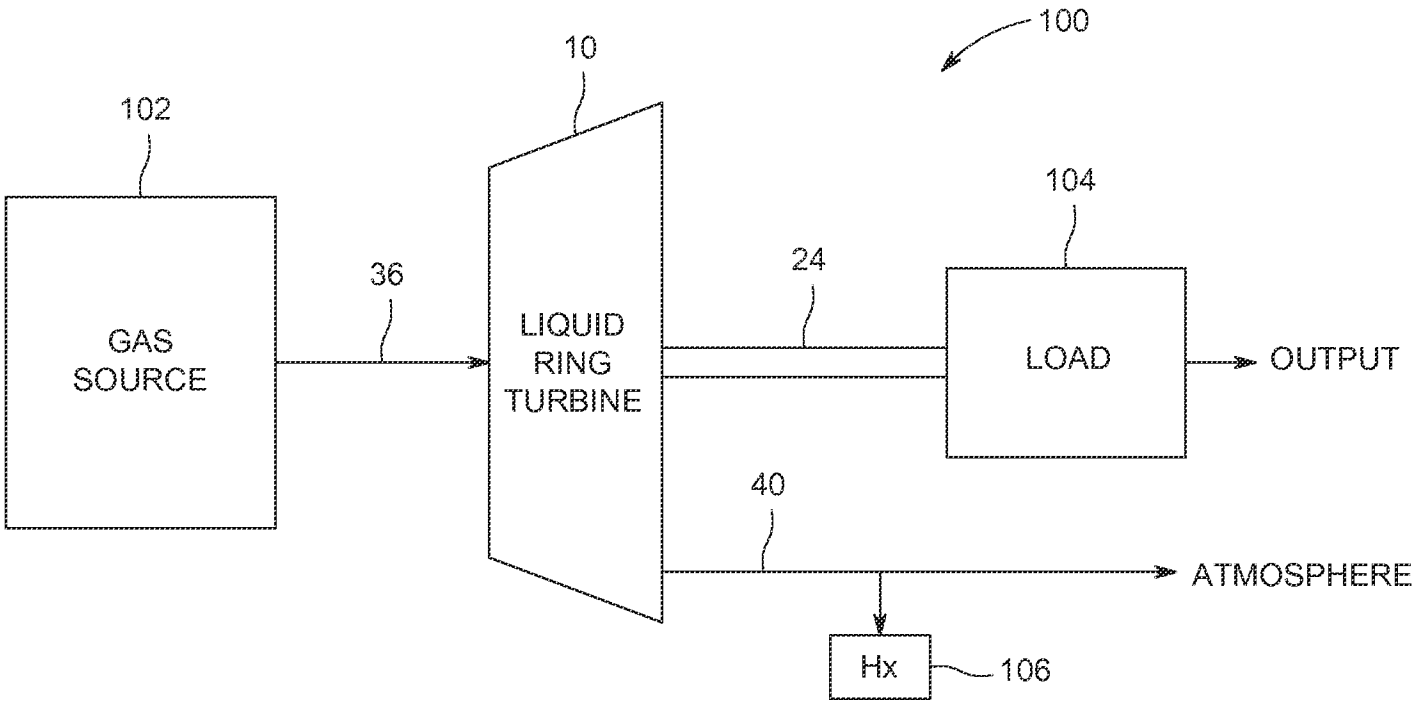
FIG. 4 illustrates a power system including the liquid ring turbine shown in FIG. 1.

FIG. 4 illustrates a power system 100 including liquid ring turbine 10. In the exemplary embodiment, power system 100 includes an enthalpy source 102 configured to direct compressed gas flow 36 to liquid ring turbine 10 through inlet duct 34 (shown in FIG. 1). As used herein, an "enthalpy source" is considered to be any suitable source of heat energy, for example, without limitation, a gas turbine, a steam turbine, a boiler, or any other source of heat that enables power system 100 to function as described herein. Compressed gas flow 36 expands in liquid ring turbine 10 causing impeller 12 to rotate, thus rotating one of shaft 24 and impeller 12. At least one of impeller 12 and shaft 24 is coupled to a load 104. In one example, load 104 is an electrical generator configured to generate electrical energy as it is rotated by the work extracted from compressed gas flow 36 by liquid ring turbine 10. Alternatively, load 104 and be any type of driven load. In the exemplary embodiment, load 104 includes an output, for example, without limitation, electrical energy. In the exemplary embodiment, liquid ring turbine 10 exhausts expanded gas flow 40 through outlet duct 38. Expanded gas flow 40 is channeled to, for example, without limitation, a heat exchanger 106 for extracting additional energy from expanded gas flow 40, exhausted to atmosphere, or used for any other purpose that enables power system 100 to function as described herein.

Figure 5:
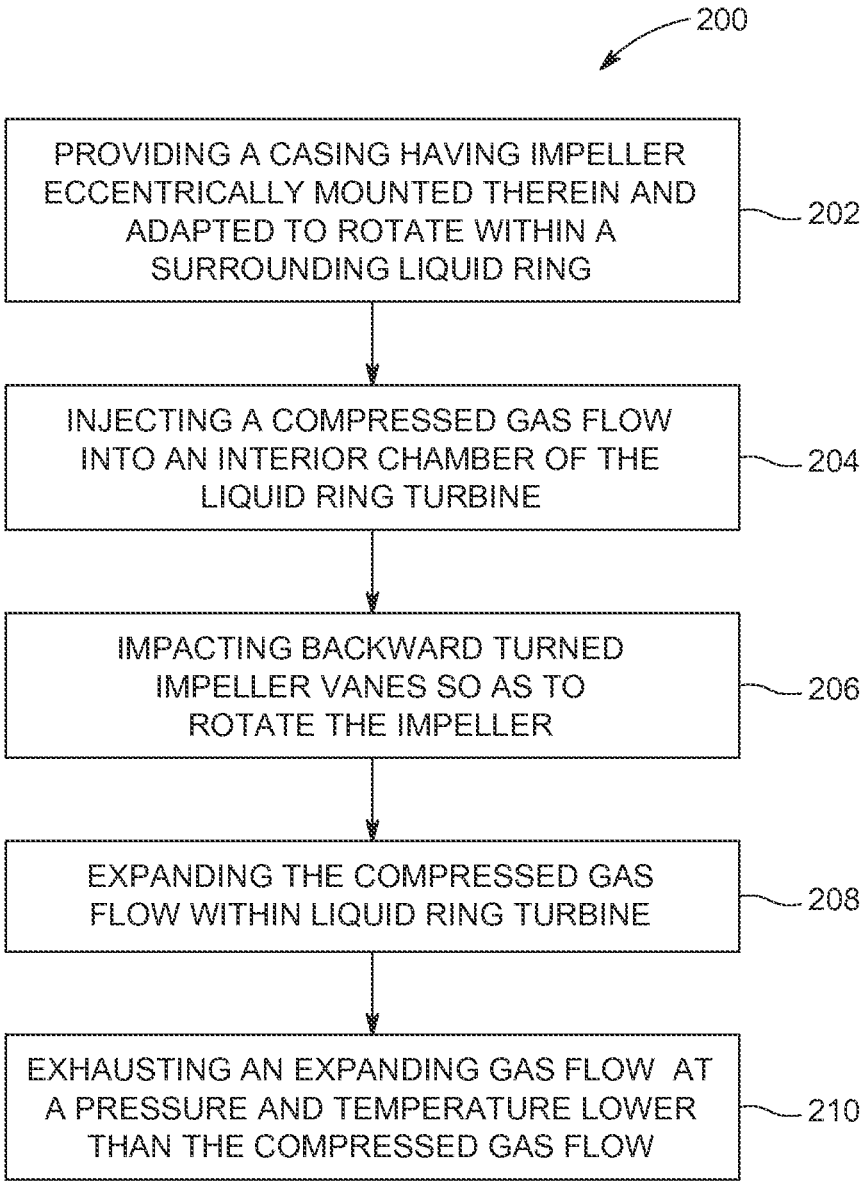
FIG. 5 is a flow chart of an exemplary method for extracting energy from a compressed gas flow shown in FIG. 3 using the liquid ring turbine shown in FIG. 1.

FIG. 5 is a flow chart of a method 200 for extracting energy from compressed gas flow 36 (shown in FIG. 1) using liquid ring turbine 10 (shown in FIG. 1). The method includes providing 202 casing 16 (shown in FIG. 1) having impeller 12 (shown in FIG. 1) eccentrically mounted therein and adapted to rotate within surrounding liquid ring 20 (shown in FIG. 1). Impeller 12 is configured such that each of impeller vanes 22 (shown in FIG. 1) form expansion chambers 30 (shown in FIG. 1) of varying volume between adjacent impeller vanes 22 and liquid ring 20. Compressed gas flow 36 is injected 204 into interior chamber 18 (shown in FIG. 1) of liquid ring turbine 10. Compressed gas flow 36 is injected at an increased pressure and temperature with respect to ambient conditions. For example, without limitation, compressed gas flow 36 includes the high temperature and high pressure exhaust gas generated by a gas turbine, the high temperature and high pressure steam used with a steam turbine, and compressed air. The injected compressed gas flow 36 impacts 206 impeller vanes 22 so as to rotate impeller 12. Impeller vanes 22 are turned at an angle with respect to a radial line extending from impeller 12 away from the direction of rotation 14 (shown in FIG. 1) of impeller 12. In addition, compressed gas flow 36 is expanded 208 within liquid ring turbine 10 as impeller 12 rotates due to expansion chamber 30 increasing in volume. Compressed gas flow 36 is exhausted 210 as expanded gas flow 40 (shown in FIG. 1) at a pressure and temperature lower than compressed gas flow 36.

The embodiments described herein enable increasing the efficiency of a liquid ring turbine by configuring impeller vanes to have a backward swept, curved or inclined, configuration with respect to a direction of rotation of the impeller. By inclining or curving the impeller blades correctly, higher power output, or efficiency, of the liquid ring turbine is gained, which results in reducing energy losses in the power system and facilitates increasing profits of the power system from operating the cycle. In particular, an angle of the impeller vanes at an interface between the gas volume and the liquid ring is determined such that the impeller vanes are substantially parallel to the force generated by the gas at the interface. This results in decreasing the negative force, or force in the opposite direction of rotation of the impeller, imparted by the gas volume on the impeller vanes.

An exemplary technical effect of the apparatus, system, and methods described herein includes injecting a compressed gas flow into an interior chamber of a liquid ring turbine to impact the impeller vanes so as to rotate the impeller. The impeller vanes are turned at an angle away from the direction of rotation of impeller with respect to a radial line extending from impeller to facilitate reducing the negative forces generated by the gas volume on the impeller. The compressed gas flow is expanded within the liquid ring turbine and exhausted as an expanded gas flow at a pressure and temperature lower than compressed gas flow, such that the energy released by the compressed gas flow is used to rotate the impeller, and in turn a driven load. Thus, the power output or efficiency of the liquid ring turbine is increased by reducing the negative forces from the compressed gas flow on the impeller blades, and the power system realizes an increase in efficiency due to the reduced system losses.

Exemplary embodiments of an apparatus, system, and method for increasing the efficiency of a liquid ring turbine are described above in detail. The apparatus, system, and methods described herein are not limited to the specific embodiments described, but rather, components of apparatus, systems, and/or steps of the methods may be utilized independently and separately from other components and/or steps described herein. For example, the methods may also be used in combination with other liquid ring turbine apparatuses, systems, and methods, and are not limited to practice with only the apparatuses, systems, and methods, as is described herein. Rather, the exemplary embodiments can be implemented and utilized in connection with many liquid ring turbine system applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing. This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A liquid ring turbine comprising:

a casing defining an interior chamber having an axis of symmetry;

a shaft having a longitudinal axis substantially parallel to the axis of symmetry, said shaft eccentrically positioned with respect to the axis of symmetry;

an impeller rotatably coupled to said shaft and configured to rotate in a first direction, said impeller comprising a plurality of vanes extending away from said shaft in a second direction at least partially opposite the first direction, said impeller configured to rotate in the first direction within a liquid ring enclosed within said casing such that a plurality of expansion chambers are defined, wherein each expansion chamber of said plurality of expansion chambers is defined between a pair of adjacent vanes of said plurality of vanes and the liquid ring;

a gas inlet port in fluid communication with a first expansion chamber of said plurality of expansion chambers;

a gas outlet port in fluid communication with a second expansion chamber; and wherein the second expansion chamber volume is greater than the first expansion chamber volume.

2. The liquid ring turbine in accordance with claim 1, wherein said plurality of vanes are equispaced about said shaft.

3. The liquid ring turbine in accordance with claim 1, wherein each vane of said plurality of vanes is straight and is inclined at an angle $\alpha$ with respect to a radial line extending from the longitudinal axis.

4. The liquid ring turbine in accordance with claim 3, wherein said angle $\alpha$ is determined based on at least one of an eccentricity between said shaft and the axis of symmetry of said casing, a liquid ring fill level, a rotational speed of said impeller, and a diameter of said interior chamber.

5. The liquid ring turbine in accordance with claim 4, wherein said angle $\alpha$ is substantially equal to an angle of a radially outward force generated by a gas enclosed in said first expansion chamber of said plurality of expansion chambers.

6. The liquid ring turbine in accordance with claim 1, wherein each vane of said plurality of vanes comprises a convex side and a concave side defining a vane curvature, wherein said convex side leads said concave side in the first direction.

7. The liquid ring turbine in accordance with claim 6, wherein the vane curvature is determined based on at least one of an eccentricity between said shaft and the axis of symmetry, a liquid ring fill level, a rotational speed of said impeller, and a diameter of said interior chamber.

8. The liquid ring turbine in accordance with claim 6, wherein the vane curvature is determined such that a direction of a radially outward force generated by a gas enclosed in said first and second expansion chambers is substantially equal to a direction of said each vane at an interface of the gas and the liquid ring within said first and second expansion chambers, respectively.

9. A liquid ring power system comprising:

an enthalpy source configured to generate a compressed gas flow;

a liquid ring turbine configured to receive the compressed gas flow, said liquid ring turbine comprising:

a casing defining an interior chamber having an axis of symmetry;

a shaft having a longitudinal axis substantially parallel to the axis of symmetry, said shaft eccentrically positioned with respect to the axis of symmetry;

an impeller rotatably coupled to said shaft and configured to rotate in a first direction, said impeller comprising a plurality of vanes extending away from said shaft in a second direction at least partially opposite the first direction, said impeller configured to rotate in the first direction within a liquid ring enclosed within said casing such that a plurality of expansion chambers are defined, wherein each expansion chamber of said plurality of expansion chambers is defined between a pair of adjacent vanes of said plurality of vanes and the liquid ring;

a gas inlet port in fluid communication with a first expansion chamber of said plurality of expansion chambers;

a gas outlet port in fluid communication with a second expansion chamber wherein the second expansion chamber volume is greater than the first expansion chamber volume; and a load rotatably coupled to at least one of said shaft and said impeller of said liquid ring turbine.

10. The system in accordance with claim 9, wherein said plurality of vanes are equispaced about said shaft.

11. The system in accordance with claim 9, wherein each vane of said plurality of vanes is straight and is inclined at an angle $\alpha$ with respect to a radial line extending from the longitudinal axis.

12. The system in accordance with claim 11, wherein said angle $\alpha$ is substantially equal to an angle of a radially outward force generated by a gas enclosed in said first expansion chamber of said plurality of expansion chambers.

13. The system in accordance with claim 9, wherein each vane of said plurality of vanes comprises a convex side and a concave side defining a vane curvature, wherein said convex side leads said concave side in the first direction.

14. The system in accordance with claim 13, wherein the vane curvature is determined such that a direction of a radially outward force generated by a gas enclosed in said first and second expansion chambers is substantially equal to a direction of said each vane at an interface of the gas and the liquid ring within said first and second expansion chambers, respectively.

15. A method for extracting energy from a compressed gas flow using a liquid ring turbine, said method comprising:

providing a casing including an impeller configured to rotate in a first direction, the impeller including a plurality of vanes extending at least partially in a second direction opposite the first direction, the impeller positioned eccentrically in the casing and configured to rotate within a liquid ring so as to define a plurality of expansion chambers, wherein each expansion chamber of the plurality of expansion chambers is defined between a pair of adjacent vanes and the liquid ring;

injecting a compressed gas flow into a first expansion chamber of the plurality of expansion chambers, the first expansion chamber defining a first volume, the compressed gas flow having a first temperature and a first pressure;

impacting at least one vane of the plurality of vanes with the compressed gas flow so as to rotate the impeller; and expanding the first volume of the first expansion chamber to a second volume greater than the first volume as the impeller rotates, thereby generating an expanded gas flow.

16. The method in accordance with claim 15 further comprising exhausting the expanded gas flow at a second temperature and a second pressure less than the first temperature and the first pressure, respectively.

17. The method in accordance with claim 15, wherein providing the casing including the impeller configured to rotate in a first direction comprises providing the impeller including a plurality of straight vanes inclined at an angle $\alpha$ with respect to a radial line extending from a longitudinal axis of the impeller.

18. The method in accordance with claim 17 further comprising determining the angle $\alpha$ that is substantially equal to a direction of a radially outward force generated by the compressed gas flow enclosed in the first expansion chamber.

19. The method in accordance with claim 15, wherein providing the casing including the impeller configured to rotate in a first direction comprises providing the casing including the impeller configured to rotate in the first direction, the impeller including a plurality of backward curved vanes, each vane of the plurality of backward curved vanes including a convex side and a concave side defining a vane curvature, wherein the convex side leads the concave side in the first direction.

20. The method in accordance with claim 19 further comprising determining the vane curvature such that a direction of a radially outward force generated by the compressed gas flow enclosed in the first expansion chamber is substantially equal to a direction of each vane of the plurality of backward curved vanes at an interface of the compressed gas flow and the liquid ring within the first expansion chamber.

* * * * *